US006810892B2

(12) United States Patent
Lai

(10) Patent No.: US 6,810,892 B2
(45) Date of Patent: Nov. 2, 2004

(54) SELF-TILTING CONNECTOR MECHANISM OF AN UMBRELLA

(76) Inventor: Jin Sheng Lai, PO Box 82-144, Taipei (TW)

( * ) Notice: Subject to any disclaimer, the term of this patent is extended or adjusted under 35 U.S.C. 154(b) by 0 days.

(21) Appl. No.: 10/309,240

(22) Filed: Dec. 4, 2002

(65) Prior Publication Data

US 2004/0107979 A1 Jun. 10, 2004

(51) Int. Cl.[7] ..... A45B 11/00
(52) U.S. Cl. ..... 135/20.3
(58) Field of Search ..... 135/20.3, 20.1, 135/25.41; 242/400; 254/387

(56) References Cited

U.S. PATENT DOCUMENTS

| | | | | |
|---|---|---|---|---|
| 3,926,202 A | * | 12/1975 | Uthemann et al. | 135/20.3 |
| 4,582,078 A | * | 4/1986 | Ma | 135/20.3 |
| 4,877,045 A | * | 10/1989 | Lin | 135/20.3 |
| 4,878,509 A | * | 11/1989 | Tung | 135/20.3 |
| 5,029,596 A | * | 7/1991 | Tung | 135/20.3 |
| 5,437,297 A | * | 8/1995 | Crisman et al. | 135/20.1 |
| 5,711,333 A | * | 1/1998 | Vanderminden, Sr. | 135/20.3 |
| 6,173,721 B1 | * | 1/2001 | Mery | 135/16 |
| 6,230,724 B1 | * | 5/2001 | Lai | 135/20.3 |
| 6,311,705 B1 | * | 11/2001 | Ma | 135/20.3 |
| 6,364,562 B1 | * | 4/2002 | Tung | 403/93 |
| 6,446,650 B1 | * | 9/2002 | Ma | 135/20.3 |
| 6,575,182 B2 | * | 6/2003 | Tung | 135/20.1 |
| 6,588,438 B1 | * | 7/2003 | Steiner | 135/20.1 |
| 2003/0062073 A1 | * | 4/2003 | Tung | 135/20.1 |

* cited by examiner

*Primary Examiner*—Ramon O. Ramirez
*Assistant Examiner*—Kofi Schulterbrandt
(74) *Attorney, Agent, or Firm*—Leong C. Lei

(57) ABSTRACT

A self-tilting connector mechanism of an umbrella is disclosed. The mechanism comprises a seat, a tilting head seat, a pulling shaft, a steel cable and a linking shaft. The seat and the tilting head seat are each provided with a pulley. Using a locking means to position the linking shaft between the tilting head seat and the pulling shaft, such that the pulling shaft is inserted into the through hole of the small tubular section of the seat, and a restoration spring is provided between the pulling shaft and the tubular section, and a steel cable is wound at the pulleys of the seat and the tilting head seat, and the steel cable is mounted to the handle rotating shaft of the main shaft of the umbrella, by rotating adjustment of the hand, the opening, tilting, reverse-tilting and closing of umbrella can be obtained.

1 Claim, 6 Drawing Sheets

SELF-TILTING CONNECTOR MECHANISM OF AN UMBRELLA

BACKGROUND OF THE INVENTION (a) Technical Field of the Invention

The present invention relates to a connector mechanism for an umbrella, and in particular, to a mechanism having a tilting head seat, and an linking shaft to achieve the opening and closing of umbrella by rotating the handle of the umbrella manually.

(b) Description of the Prior Art

Large umbrella is used to block sunlight and rain, and is commonly found in tourist spots, resorts, or restaurants and it is an essential equipment for leisure life. Conventional umbrella comprises umbrella clothes, umbrella frame, seat and a control mechanism. Generally the handle of the umbrella controls the opening of the umbrella, and the function of tilting the umbrella has to be performed with another single operation. The position for tilting the umbrella is at a higher position from the base of the umbrella and both hands of the umbrella user have to be used and a greater strength is needed in the operation of the umbrella. Therefore, it is no convenient in tilting a conventional large umbrella.

In order to solve the drawback of the conventional large umbrella, an auto tilt umbrella is exploited and the opening and tilting operation of the umbrella are controlled by the handle of the umbrella. That is, the continuation of rotating of the handle will open the umbrella or tilting the umbrella. However, the auto tilt umbrella that available in the market generally needs at least 5–6 kgf of strength to operate the handle, and a tilting movement of the umbrella will occur accidentally under a comparatively large wind action. This is not an ideal large umbrella for use in most of occasions and therefore, it is an object of the present invention to provide a self-tilting connector mechanism of an umbrella which mitigates the above drawbacks.

SUMMARY OF THE INVENTION

Accordingly, it is an object of the present invention to provide a self-tilting connector mechanism of an umbrella comprising a seat having a hollow tubular body and the bottom section thereof being a tube section with through hole, the top end thereof being a locking hole and a sectional slot; a tilting head seat mounted within the seat body, the interior of the upper section of the tilting head seat being moveably locked with a pulley, and the bottom section thereof downwardly mounted with two protruded plates forming an open slot therebetween, the two protruded plates being provided with a positioning hole and a combining hole; a steel cable having one end mounted to the umbrella runner and having the other end mounted to a rotating shaft of a handle and being wound around a positioning pulley located at the upper section of the umbrella runner, the pulley on the tilting head seat and the driving pulley of a pulling shaft; a linking shaft having an elongated body and having a bottom end and a top end individually provided with hole, the lower section of the top end hole being mounted with a spring and a positioning button; a pulling shaft having a sectional slot at the upper section thereof, and the interior of the sectional slot being provided with two locking holes for moveably mounting a driving pulley and the linking shaft, the end terminal of the bottom section of the pulling shaft being mounted with a spring such that the spring urges the small tubular section of the seat, the lower section of the spring is transversely mounted with a locking pin to prevent the dislocation of the spring; thereby the linking shaft locks at the combining hole of the bottom section of the two protruded plates of the tilting head seat and locks at the sectional slot of the pulling shaft such that the pulling shaft is mounted at the hole of the small tubular section of the bottom section of the seat, by means of the winding of the steel cable, the rotating adjustment of the handle can achieve opening, tilting and reverse tilting, and closing of the umbrella.

Yet another object of the present invention is to provide a self-tilting connector mechanism of an umbrella, wherein the movement of the umbrella is only obtained by the control of the handle of the umbrella.

Other objects, and advantages of the present invention can be more fully understood by reading the following detailed description of the preferred embodiment, with reference to the accompanying.

DETAILED DESCRIPTION OF THE PREFERRED EMBODIMENTS

Figure 1:
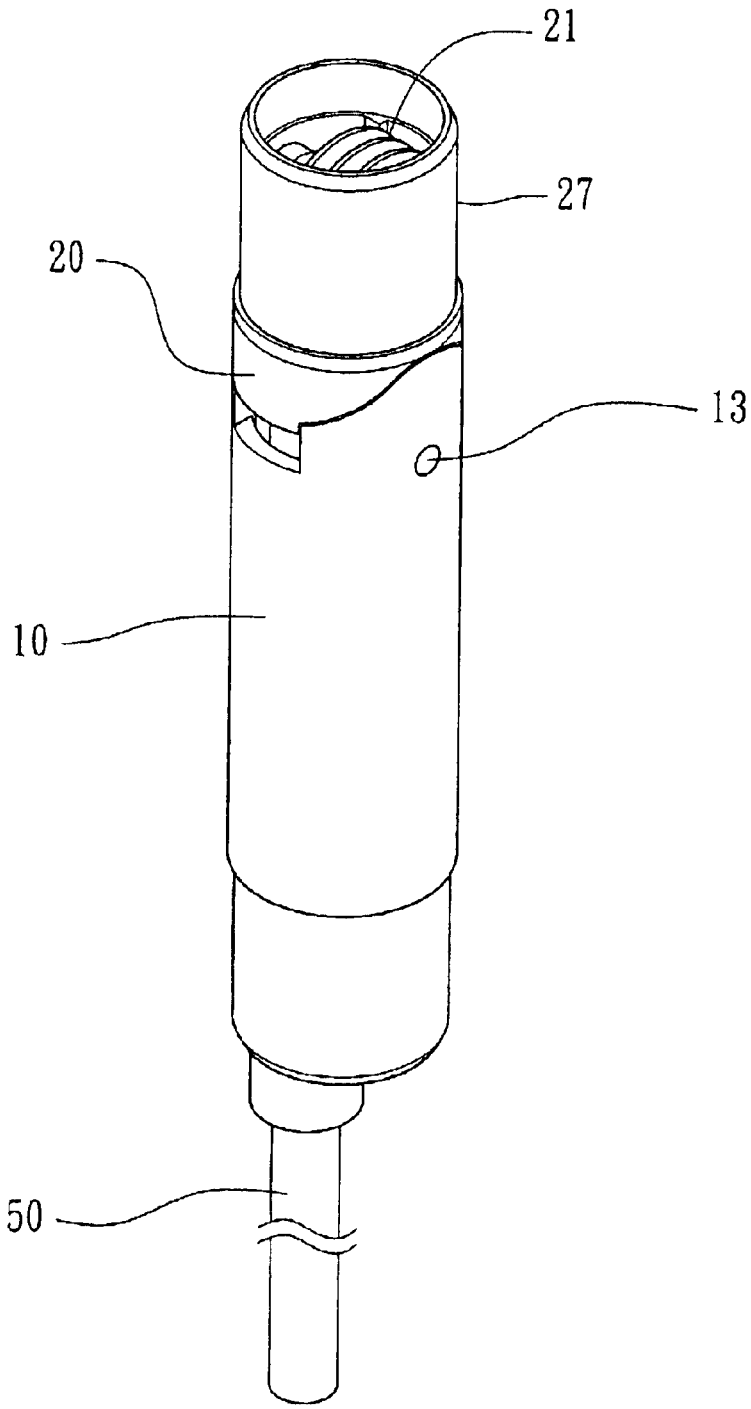
FIG. 1 is a perspective view of a preferred embodiment of the present invention.
Figure 2:
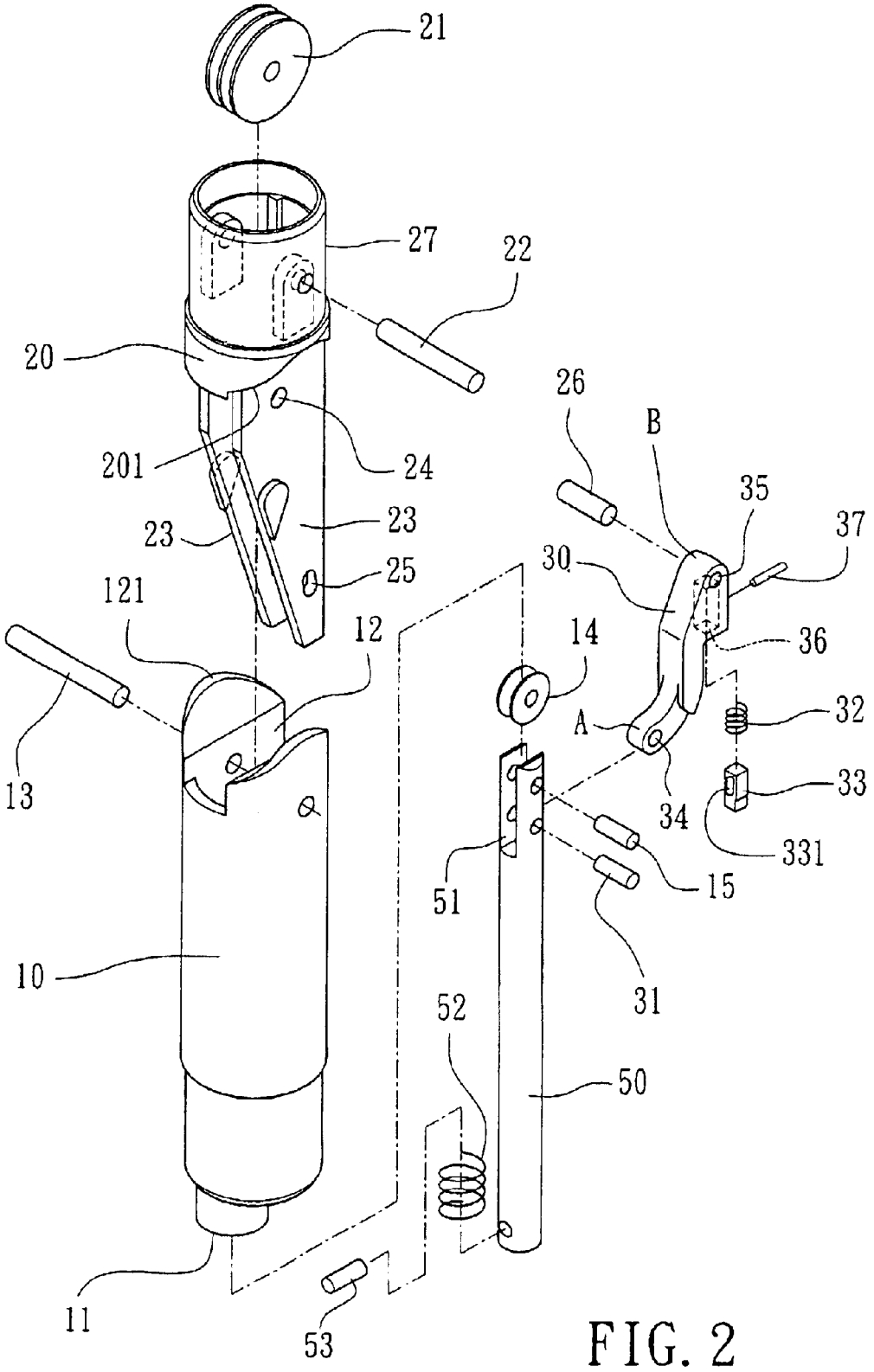
FIG. 2 is an exploded view of a preferred embodiment of the present invention.

Referring to FIGS. 1 and 2, there is shown a self-tilting connector mechanism of an umbrella comprising a seat 10, a tilting head seat 20, a linking shaft 30, a steel cable 40 (referring to FIG. 6) and a pulling shaft 50.

In accordance with the present invention, the bottom section of the seat 10 is provided with a through hole 11 having a small tubular section. The through hole 11 can mount with the pulling shaft 50, and the upper end of the seat 10 is provided with a vertical slot 12. The top face is formed into a top arch 121, and the horizontal direction of the slot 12 is provided with a peg 13, which passes through the positioning hole 24 of the tilting head seat 20, achieving the tilting head seat 20 at the seat 10 being swung to a specific angle.

The top of the interior of the tilting head seat 20 has a peg 22 to position a pulley 21. The bottom section of the tilting head seat 20 is provided with two protruded plates 23. The top and bottom position of the two protruded plates 23 are provided with a positioning hole 24 and elongated combining hole 25, a cylindrical face 27 connected to the top rod of the umbrella runner, a linking shaft 30 having an elongated body and having a bottom end and a top end individually provided with hole, the lower section of the top end hole being mounted with a spring 32 and a positioning button 33; a pulling shaft 50 having a sectional slot 51 at the upper section thereof, and the interior of the sectional slot 51 being provided with two locking holes for moveably mounting a driving pulley 14 and the linking shaft 30, the end terminal of the bottom section of the pulling shaft 50 being mounted with a spring 52 such that the spring 52 urges the small tubular section of the seat 10, the lower section of the spring 52 is transversely mounted with a locking pin 53 to prevent the dislocation of the spring.

Figure 3:
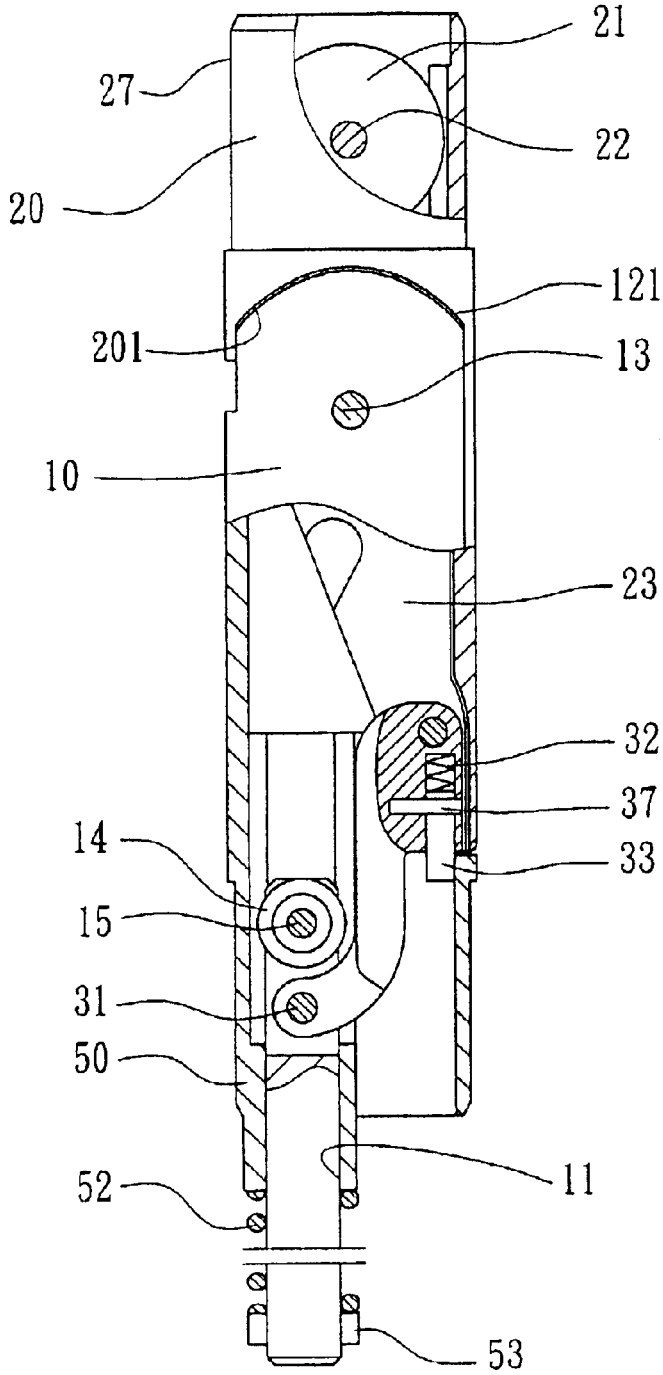
FIG. 3 is a sectional view of a preferred embodiment of the present invention, wherein the mechanism is in an upright position.

As shown in FIG. 3, in combination, the bottom end A of the linking shaft 30 is mounted at the sectional slot 51 of the pulling shaft 50. The peg 31 locks the positioning hole 34 at the bottom end of the linking shaft 30 to the sectional slot 51. At the same time, the driving pulley 14 uses a positioning peg 15 to lock to the sectional slot 51, and the top end B of the linking shaft 30 is placed at the slot of the two protruded plates 23. A peg 26 is used to lock the combining holes 25, 35.

Figure 6:
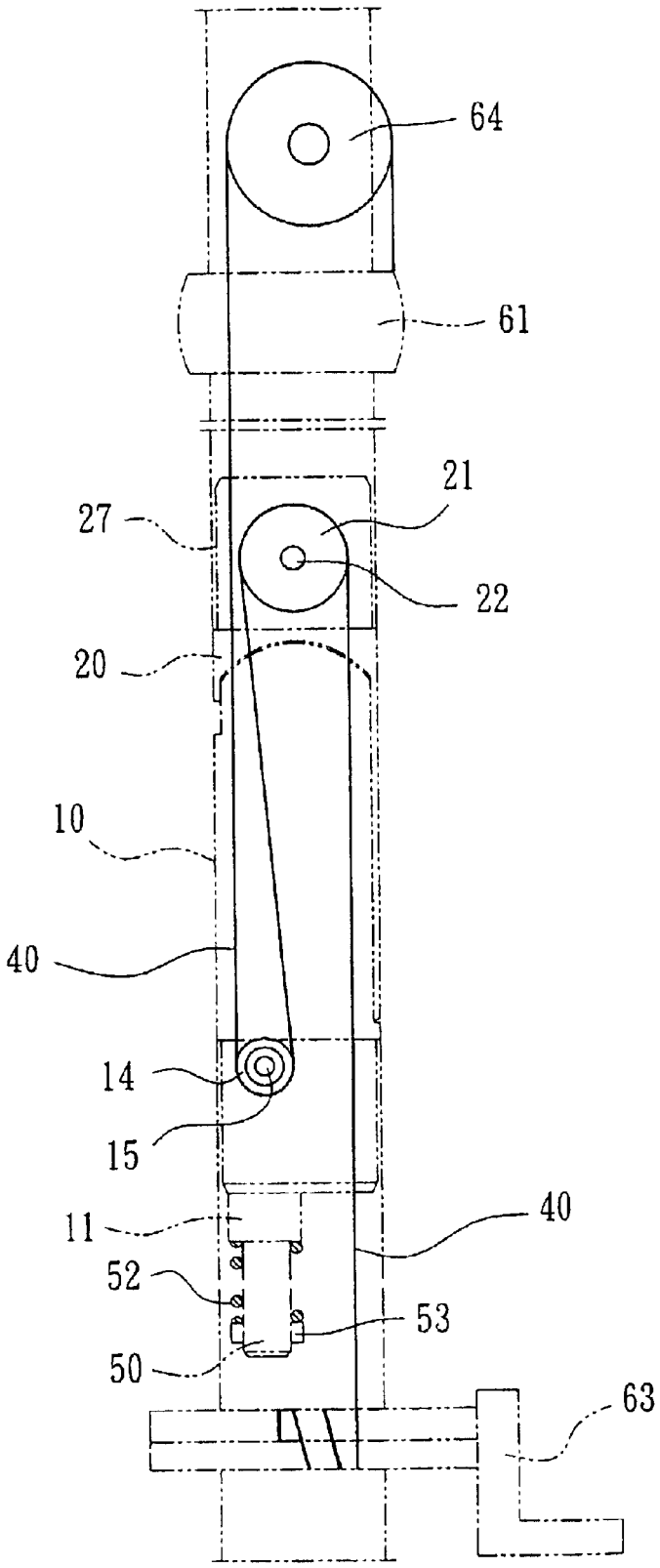
FIG. 6 is a schematic view showing a steel cable wound around the umbrella in accordance with the present invention.

The spring 32 and the positioning button 33 are inserted into the engaging slot 36, and an external peg body 37 passes through the positioning hole on the linking shaft 30 (not shown) and the sliding slot of the positioning button 33, and the positioning button 33 is engaged at the linking shaft 30 so that the positioning button 33 is the displacement and restoration displacement of up-down fixed distance. The tilting head seat 20 of the pulley 21 is placed into the seat 10 along the slot 12, and a peg 13 locks the tilting head seat 20 at the seat 10 such that the tilting head seat 20, the linking shaft 30, the seat 10 and the pulling shaft 50 form into a unit. As shown in FIG. 6, one end of the steel cable 40 is mounted at the lower section of the handle 63, and the other end is inserted to the seat 10 by first passing through the sectional slot 51 to surround the pulley 21, and is extended downward, through the open slot of the two protruded plates 23 and surrounds the pulley 14. Finally, upward extension through the seat 10 and the tilting head seat 20 and surround over the pulley 64 at the top end of the umbrella, and an umbrella runner 61 is mounted onto the top shaft.

Figure 4:
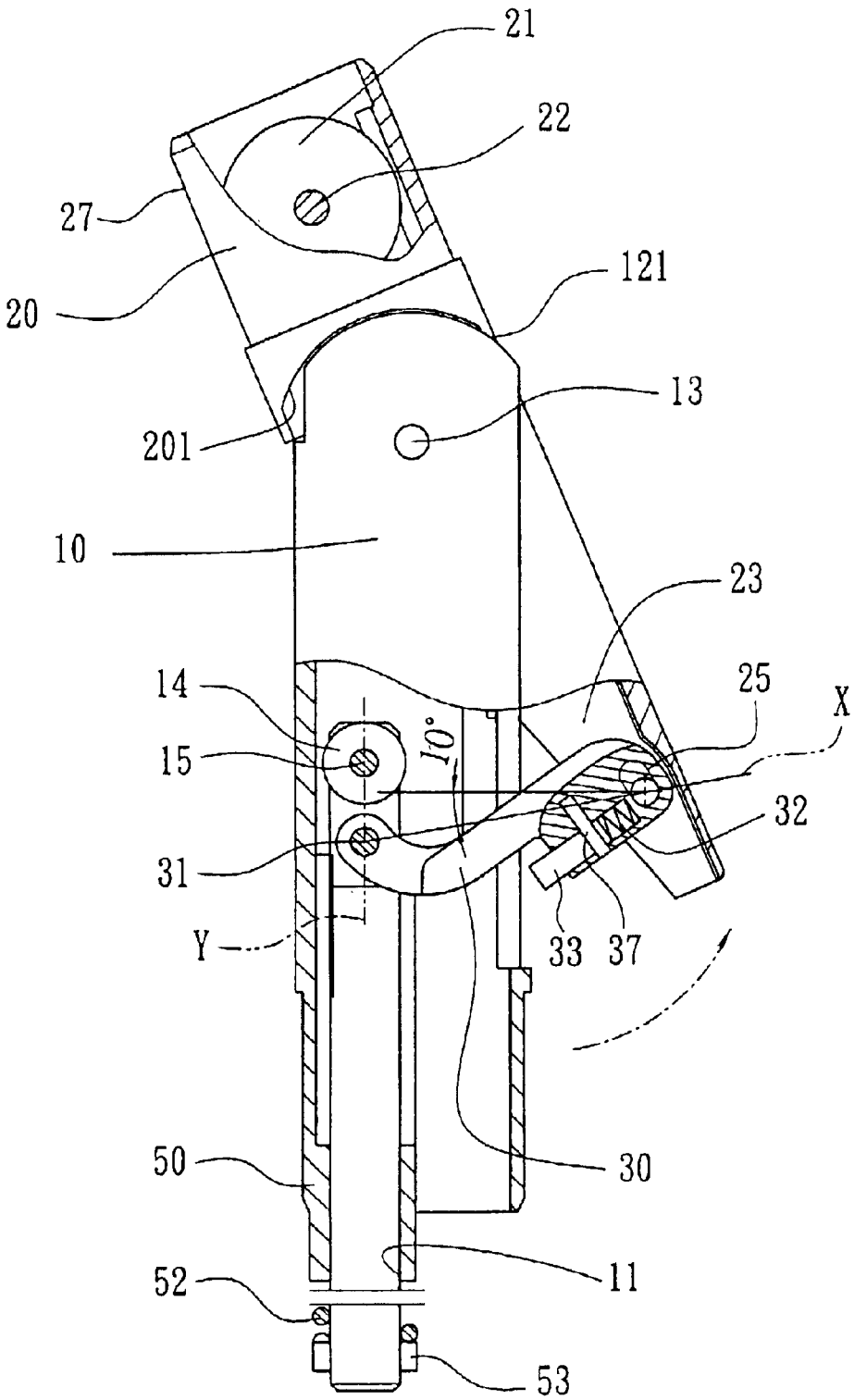
FIG. 4 is a schematic view of application of the present preferred embodiment, wherein the tilting head is bent to a limited position.
Figure 5:
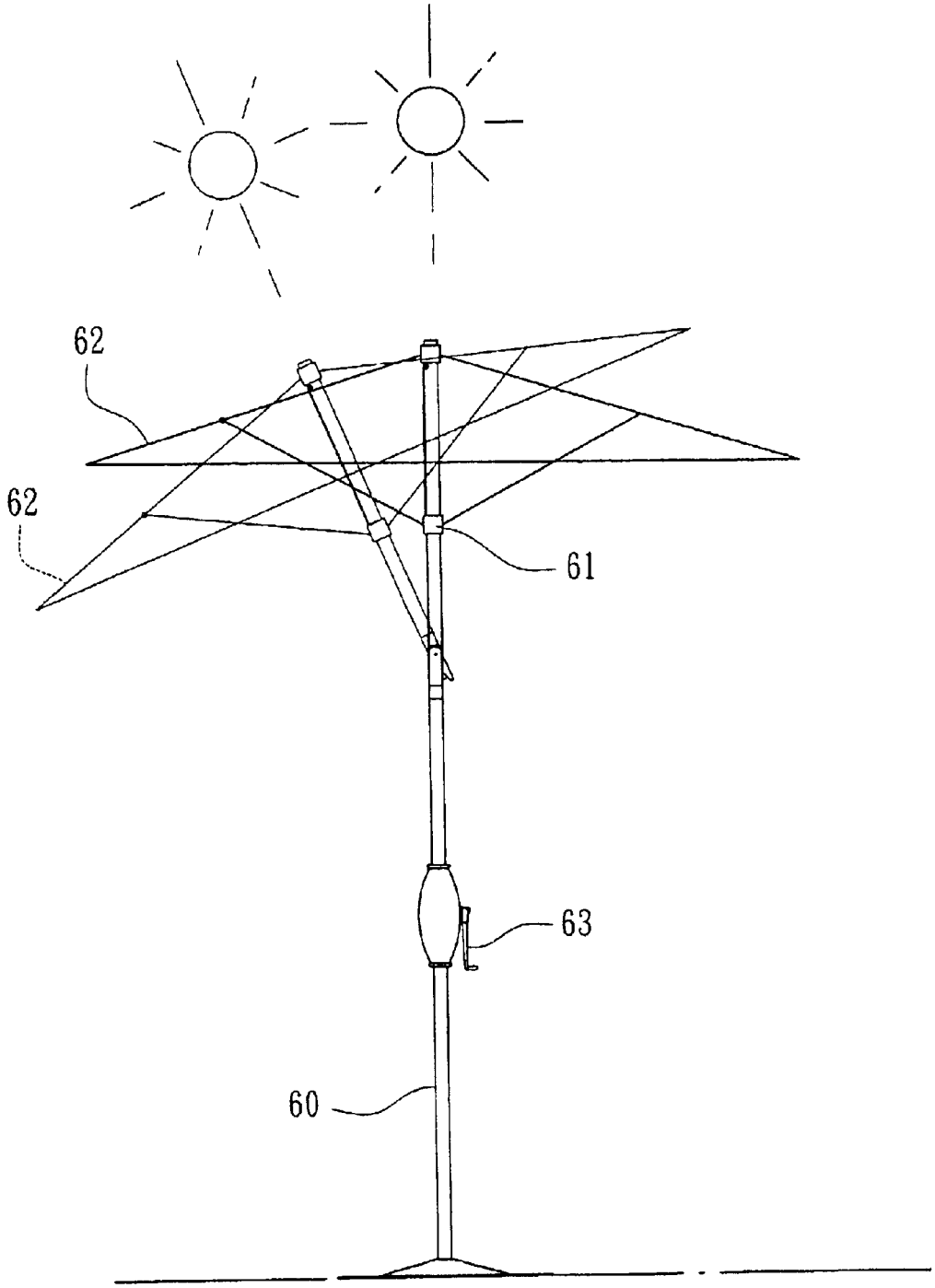
FIG. 5 is a schematic view of the application of the umbrella in accordance with the present invention.

Referring to FIGS. 4, 5, when the umbrella is at a closed position, and the user is facing the handle 63. Only the handle 63 is rotated clockwise, the steel cable 40 along the pulley 21 and the driving pulley 14 and surrounds at the rotating shaft of the handle 63 so that the umbrella runner 61 is lifted by a reaction force. Thus, the umbrella surface is opened.

In addition, when the umbrella is opened (to a maximum position) and if the handle 63 is rotated clockwise, the steel cable 40 will be wounded to drive. The top end of the steel cable 40 is a fixed point, and through the driving pulley 14 and the pulley mechanism of the pulley 21, the pulling shaft 50 is driven upward, and the tilting head seat 20 is restricted by the pegging of the peg 13. Thus, the linking rod 30 is rotated to push the protruded plate 23 of the tilting head seat 20 to go outwardly, and the recessed arch 201 will tilt downward, and the linking rod 30 moves upward to compress the spring 52 connected to the bottom end of the tilting head seat 20 and at the same time the positioning button 33 is released from the fastening position of the seat 10, and the linking shaft 30 inclines at the swing head with an appropriate angle.

When the inclination of the tilting head seat 20 is at a maximum (about 23 degree) the exerted Y-axis of the linking shaft 30 and the moving shaft X of the pulling rod 50 maintains at 10 degree (smaller than the friction angle). That is the working condition of the tilting head seat 20 maintains self-locking and any external force exerted on the umbrella surface 62 or frame will not cause the umbrella to swing or to slide downward.

If the umbrella is not in use, the handle 63 is rotated counter-clockwise. The pulling rod 50 under the spring force of the spring will restore to its restoration position, and at the same time the linking shaft 30 moves downward such that the tilting head seat 20 rotates to a right position to its tilting position. In accordance with the present invention, the operation is simple and convenient.

In accordance with the present invention, the advantages of the mechanism are as follows:

1. The structure of the mechanism is simple and after mounting with the mechanism, the appearance of the umbrella is not affected, and by rotating the handle, the opening, tilting and reverse tilting, and closing of the umbrella can be achieved.

2. A positioning button is provided to firmly secure the umbrella at an upright position, and the tilting head will not be affected by external force.

3. Do not need excessive strength to open, close, and tilt the umbrella.

Thus, it is conveniently used at any time and anywhere.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A self-tilting connector mechanism of an umbrella comprising:

(a) a seat having a hollow tubular body and a bottom section thereof being a tube section with a through hole, a top end thereof being a locking hole and a sectional slot;

(b) a tilting head seat mounted within the body, an interior of an upper section of the tilting head seat being moveably locked with a pulley, and a bottom section thereof being mounted with two protruded plates forming an open slot therebetween, the two protruded plates being provided with a positioning hole and a combining hole;

(c) a steel cable having one end mounted to an umbrella runner and having the other end mounted to a rotating shaft of a handle and being wound around a positioning pulley located at an upper section of the umbrella runner, the pulley on the tilting head seat and the driving pulley of a pulling shaft;

(d) a linking shaft having an elongated body and having a bottom end and a top end each provided with a hole, a lower section of the hole of the top end being mounted with a spring and a positioning button;

(e) a pulling shaft having a sectional slot at an upper section thereof, and an interior of the sectional slot being provided with two locking holes for moveably mounting a driving pulley and the linking shaft, the end terminal of the bottom section of the pulling shaft being mounted with a spring such that the spring urges a tubular section of the seat, a lower section of the spring being transversely mounted with a locking pin to prevent dislocation of the spring;

wherein a lower section of the linking shaft has an engaging slot having a spring and the positioning button having a sliding slot, and the linking shaft is provided with a positioning slot, and a locking body is drive, and the top end of the steel cable is a fixed point., and through the driving pulley and the pulley mechanism of the pulley, the pulling shaft is driven upward, and the tilting head seat is restricted by the pegging of the peg, and thus the linking rod is rotated to push the protruded plate of the tilting head seat to go outwardly, and the recessed arch will tilt downward, and the linking rod moves upward to compress the spring connected to the bottom end of the tilting head seat and at the same time the positioning button is released from the fastening position of the seat, and the linking shaft inclines at the swing head with an appropriate angle;

whereby the linking shaft locks at the combining hole of the bottom section of the two protruded plates of the tilting head seat and locks at the sectional slot of the pulling shaft such that the pulling shaft is mounted at the hole of the tubular section of the bottom section of the seat, and by means of winding of a steel cable, rotating adjustment of the handle can achieve opening, tilting and reverse tilting, and closing of the umbrella.

* * * * *